US006126873A

United States Patent [19]

Zedalis et al.

[11] Patent Number: 6,126,873

[45] **Date of Patent: *Oct. 3, 2000**

[54] PROCESS FOR MAKING STAINLESS STEEL AQUEOUS MOLDING COMPOSITIONS

[75] Inventors: Michael Sean Zedalis, Mendham; Rick Duyckinck, Ringoes; Brian Snow, Parsippany; Anthony Fanelli, Morris Plains; Joan Virginia Burlew, Rockaway, all of N.J.

[73] Assignee: AlliedSignal Inc., Morris Township, N.J.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/090,075

[22] Filed: Jun. 3, 1998

[51] Int. Cl.[7] ..... C04B 35/636

[52] U.S. Cl. ..... 264/28; 264/621; 264/328.2; 264/328.17; 419/36

[58] Field of Search ..... 264/109, 621, 264/328.2, 28, 328.17, 328.1; 419/36

[56] References Cited

U.S. PATENT DOCUMENTS

| | | | |
|---|---|---|---|
| 3,489,553 | 1/1970 | Duletsky . | |
| 4,113,480 | 9/1978 | Rivers | 75/214 |
| 4,734,237 | 3/1988 | Fanelli et al. | 264/122 |
| 5,258,155 | 11/1993 | Sekido et al. | 264/109 |
| 5,340,532 | 8/1994 | Bergstrom . | |
| 5,746,957 | 5/1998 | Fanelli et al. | 264/109 |

FOREIGN PATENT DOCUMENTS

| | | |
|---|---|---|
| 0-576-282 | 12/1993 | European Pat. Off. . |
| 10298610 | 11/1998 | Japan . |

OTHER PUBLICATIONS

German, R.M. (1990). *Powder Injection Molding*, New Jersey: Metal Powder Industries Federation.

Whistler, R.L., et al. (1973). *Industrial Gums*. New York: Academic Press.

German, R.M. (1994). *Powder Metallurgy Science*. New Jersey: Metal Powder Industries Federation.

Klar, E. et at (1984). *Metals Handbook® Ninth Edition Vol. 7 Powder Metallurgy*. Ohio.

American Society for Metals.

Davis, J.R. et al. (1990) *Metals Handbook® Tenth Edition vol. 1 Properties and Selection: Irons, Steels, and High Performance Alloys*. Ohio: American Society for Metals.

*Primary Examiner*—Jan H. Silbaugh
*Assistant Examiner*—Kenneth M. Jones
*Attorney, Agent, or Firm*—Roger H. Criss

[57] ABSTRACT

Molding compositions for shaping parts from stainless steel powders are disclosed. The process comprises the steps of forming a mixture comprising stainless steel powder, a gel-forming material having a gel strength, measured at a temperature between 0° C. and about 30° C. and a gel comprising about 1.5 wt % of the gel-forming material and water, of at least about 200 g/cm2, and water, and molding the mixture at a temperature sufficient to produce a self-supporting article comprising the powder and gel. The preferred gel-forming material is an agaroid and the preferred molding process is injection molding.

27 Claims, 3 Drawing Sheets

INJECTION MOLDING PROCESS

INJECTION MOLDING PROCESS

PROCESS FOR MAKING STAINLESS STEEL AQUEOUS MOLDING COMPOSITIONS

FIELD OF INVENTION

This invention relates to stainless steel molding compositions for producing parts having excellent sintered properties from powders. More particularly, the invention is directed to molding processes and molding compositions for forming complex parts which exhibit excellent green strength and which can be readily fired to high quality sintered products without experiencing the cracking, distortion and shrinkage problems commonly associated with prior art sintered products.

BACKGROUND OF THE INVENTION

The production of sintered parts from "green" bodies is well known in the art. Generally, the green body is formed by filling a die with a powder/binder mixture and compacting the mixture under pressure to produce the green body. The green body, a self supporting structure, is then removed from the die and sintered. During the sintering process, the binder is volatilized and burned out. However, removal of the binder can cause the product to crack, shrink and/or become distorted.

The injection molding of metal parts from powders has been a particularly troublesome process, and notably, processes based on water as the fluid transporting medium. It is well known that finely divided metal powders (M) can react with water ($H_2O$) to form oxides on the surface according to:

$$xM+yH_2O=M_xO_y+yH_2$$

(*Metals Handbook*, vol 7, p 36, American Society for Metals, Metals Park, Ohio, 1984). It is also recognized that the thickness of the oxide film is inversely proportional to the particle size of the metal powder (*Metals Handbook*, vol 7, p 37, American Society for Metals, Metals Park, Ohio, 1984). Impurities, in particular, surface oxides, can lead to weak interparticle bonding during sintering, resulting in inferior mechanical properties in the fired part (R. M. German, *Powder Metallurgy Science*, p 304, Metal Powder Industries Federation, Princeton, N.J., 1994).

Recently, a water-based process using methylcellulose polymers as binders in the manufacture of parts from metal powders has been disclosed. U.S. Pat. No. 4,113,480 discloses the use of methylcellulose or other plastic media (e.g., polyvinyl alcohol) and water in forming injection molded metallic parts. With respect to the mechanical properties of the final parts, however, the elongation disclosed in the tabulated mechanical properties is only marginal at 2.6% and 2.5%. Moreover, aqueous solutions of methylcellulose are fluid at temperatures around 25° C. and gel at elevated temperatures roughly in the range 50–100° C. This particular mode of gelling behavior necessitates molding from a cool barrel into a heated die. The elevated die temperature can cause the molded part to lose water by evaporation prematurely before it is totally formed, resulting in non-uniform density in the molded part. This density inhomogeneity can lead to cracking and warping in subsequent processing steps of drying and sintering.

The use of aqueous solutions of agaroids as binders for injection molding ceramic and metal parts is disclosed in U.S. Pat. No. 4,734,237. However, examples containing only ceramic compositions are given and no stainless steel compositions are provided.

Suitable injection molding compositions must be those which are capable of transforming from a highly fluid state (necessary for the injection step to proceed) to a solid state having a high green strength (necessary for subsequent handling).

In order to meet these requirements, and avoid the potentially damaging metal-water chemical reactions, most prior art molding compositions comprise a relatively high percentage of a low melting point binder, such as wax (R. M. German, *Powder Injection Molding*, Metal Powder Industries Federation, Princeton, N.J., 1990). However, such systems exhibit a number of problems in forming parts, especially parts of complex shapes.

More specifically, waxes are commonly employed as binders because they exhibit desirable rheological properties such as high fluidity at moderately elevated temperatures and substantial rigidity at temperature below about 25° C. Wax formulations normally comprise between about 35% and about 45% organic binder by volume of the formula. During the firing process, wax is initially removed from the body in liquid form. During this initial step of the firing process, the green body may disintegrate or become distorted. Consequently, it is often necessary to preserve the shape of the green body by immersing it in an absorbent refractory powder (capable of absorbing the liquid wax). Notwithstanding the use of the supporting powder to retain the shape of the body, the formation of complex shapes from wax-based systems is even more difficult because it requires, in most instances, detailed firing schedules which may encompass several days in an attempt to avoid the development of cracks in the part.

In spite of the problems associated with aqueous compositions of metallic powders enumerated above we have found, unexpectedly, novel molding compositions useful in forming complex shapes which can be fired to stainless steel products with excellent mechanical properties. Furthermore, the novel molding compositions disclosed are useful in forming stainless steel parts which not only reduce the firing times and regimens for such parts, but also allow for the production of complex shapes without the attendant shrinkage and cracking problems associated with the prior art products. Moreover, the compositions can be molded in the "conventional" manner, i.e., from a heated injection molding barrel into a cool die.

Generally speaking stainless steels refer to Fe/Cr alloys. Invariably, other elements are included to attain certain properties. Five classes of stainless are delineated in the metals handbook (*Metals Handbook*, Tenth Edition, Vol 1, ASM International, Materials Park, Ohio, 1990) comprising austenitic, ferritic, martensitic, duplex and precipitation hardened alloys. Basic formulations for the five categories are given on p 843 of the handbook. The elements frequently alloyed with Fe and Cr comprise Ni, Mn, Mo, Al, Nb, Ti, Ca, Co, Cu, V, and W.

BRIEF SUMMARY OF THE INVENTION

The invention is directed to stainless steel molding compositions and a process for shaping parts from powders which comprises the steps of forming a mixture comprising metal powders, a gel-forming material having a gel strength, measured at a temperature between 0° C. and about 30° C. on a gel comprising about 1.5 weight percent of the gel forming material and water, of at least 200 g/cm2, and a liquid carrier, supplying the mixture to a mold, and molding the mixture under conditions of temperature and pressure to produce a self-supporting structure.

The invention is also drawn to an injection molding process comprising the steps of forming a mixture comprising stainless steel powder, a gel-forming material having a gel strength, measured at a temperature between 0° C. and about 30° C. on a gel comprising about 1.5 weight percent of the gel-forming material and water, of at least 200 g/cm$^2$, injecting the mixture at a temperature above the gel point of the gel-forming material into a mold, cooling the mixture in the mold to a temperature below the gel point of the gel-forming material to produce a self supporting structure, and removing the structure from the mold. Preferably, the gel consists essentially of about 1.5 weight percent of the gel-forming material and water.

The invention is also directed to a composition of matter comprising between about 50 wt % and about 96 wt % metal powder and at least about 0.5 wt % gel-forming material having a gel strength, measured at a temperature between 0° C. and about 30° C. on a gel comprising about 1.5 wt % of the gel-forming material and water, of at least about 200 g/cm2.

DETAILED DESCRIPTION OF THE INVENTION

Figure 1:
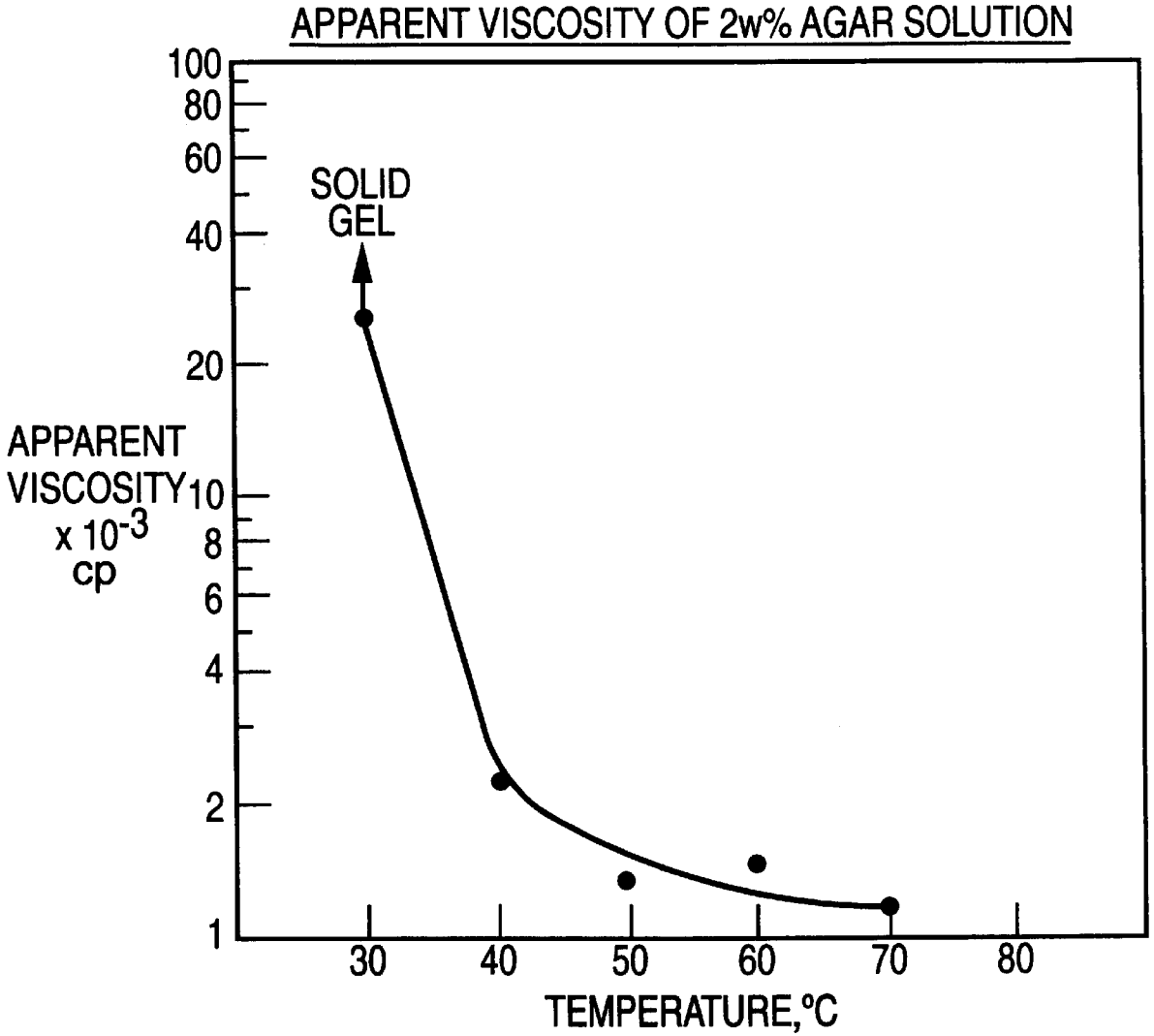
FIG. 1 is a graphic representation of the apparent viscosity of a 2 wt % agar solution at varying temperatures.
Figure 2:
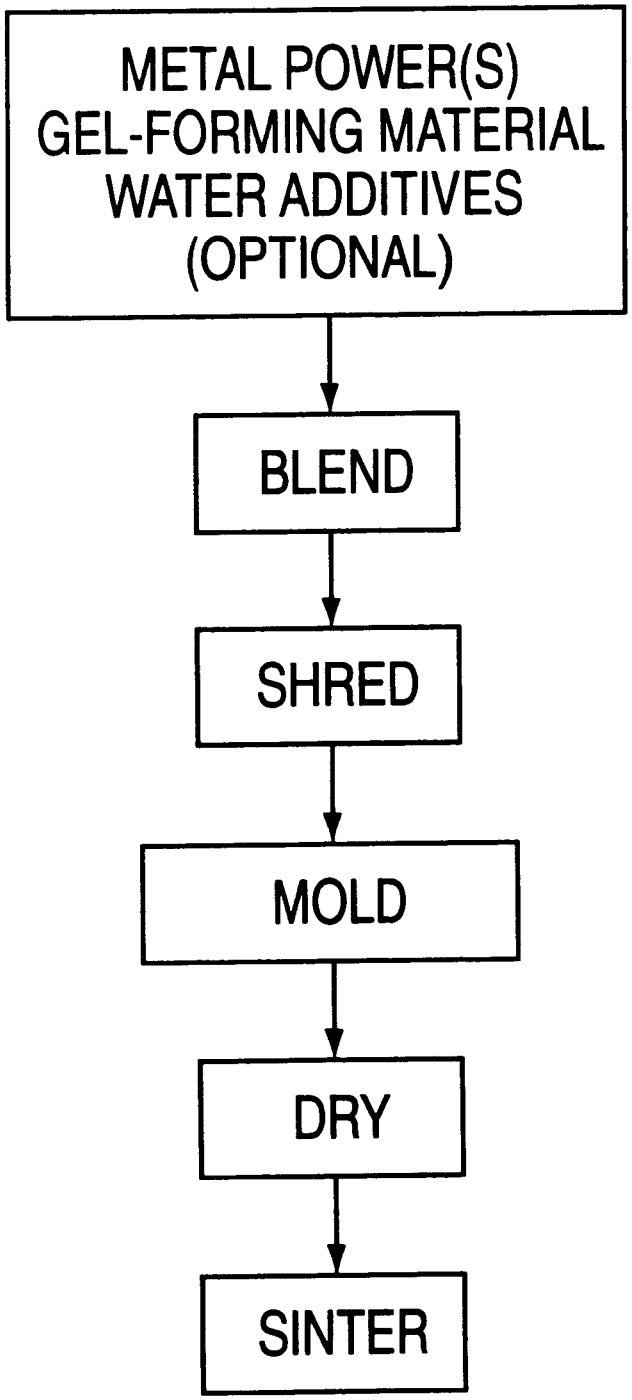
FIG. 2 is a schematic representation of the basic steps of one embodiment of the process of the invention.

Stainless steel parts are formed according to this invention from powdered materials. As used therein, the term metal powders includes powders of pure metals, alloys, intermetallic compounds, and mixtures thereof.

According to the process, the metal powders are initially mixed with gel-forming material and a liquid carrier. This mixture is proportioned to be fluid enough to enable it to be readily supplied to a die by any of a variety of techniques, and especially by injection molding. Generally, the amount of powder in the mixture is between about 50 percent and about 96 percent by weight of the mixture. Preferably, the powders constitute between about 80 percent and about 95 percent by weight of the mixture, and most preferably constitute between about 90 percent and about 94 percent by weight of the mixture. The preferred and most preferred amounts are quite useful in producing net and near net shape injection molded parts.

Generally, the particle size ($d_{90}$) of the metal powder in the mixture is between 5 and 50 $\mu$m. Preferably, the particle size is 10–30 $\mu$m, and most preferably 15–22 $\mu$m.

The gel-forming material employed in the mixture is a material which exhibits a gel strength, measured at a temperature between 0° C. and about 30° C. on a gel comprising about 1.5 wt % of the gel-forming material and water, of at least about 200 g/cm2. This value of gel strength is the minimum value necessary to produce from the mixture an article having sufficient green strength to be handled at ambient temperature without the need for special handling equipment (i.e., self-supporting). As noted above, the minimum gel strength value must be achieved at at least one temperature between 0° C. and about 30° C. is at least about 200 g/cm2, and more preferably the value of gel strength is at least about 400 g/cm2. In addition, the gel-forming materials are water soluble. The higher values of gel strength can be particularly useful in producing parts with complex shapes and/or higher weights. Furthermore, higher gel strengths enable the use of smaller amounts of the gel-forming material in the mixture.

The gel strength of the gel-forming material is measured by using an apparatus commonly employed in the manufacturing of industrial gums. The apparatus consists of a rod having a circular cross sectional area of 1 cm$^2$ at one end thereof which is suspended above one pan of a triple beam balance. Initially, a large container is placed on one pan of the triple beam balance. The container placed on the pan above which is suspended the rod is filled with about 200 ml (volume) of a gel having about 1.5 wt % of the gel-forming material and water. The empty container is then balanced against the gel-containing container. The rod is then lowered into contact with the top surface of the gel. Water is then metered into the empty container and the position of the balance pointer is continuously monitored. When the top surface of the gel is punctured by the rod, the balance pointer rapidly deflects across the scale and the water feed is immediately discontinued. The mass of water in the container is then measured and the gel strength, mass per unit area, is calculated.

An additional novel feature of the invention is the use of gel-forming materials which comprise an agaroid. An agaroid is defined as a gum resembling agar but not meeting all of the characteristics thereof. (See H. H. Selby et al., "Agar," *Industrial Gums*, Academic Press, New York, N.Y., 2nd ea., 1973, Chapter 3, p. 29). As used herein, however, agaroid not only refers to any gums resembling agar, but also to agar and derivatives thereof such as agarose. An agaroid is employed because it exhibits rapid gelation within a narrow temperature range, a factor which applicants have discovered can dramatically increase the rate of production of articles. More importantly, however, we have discovered that the use of such gel-forming materials substantially reduces the amount of binder needed to form a self-supporting article. Thus, articles produced by using gel-forming materials comprising agaroids can be significantly improved as a result of the substantial reduction in the firing regimens necessary to produce a fired product. The preferred gel-forming materials are those which are water soluble and comprise an agaroid, or more preferably, agar, and the most preferred gel-forming materials consist of agaroid, or more preferably, agar. FIG. 1 illustrates the basic features of the gel-forming material by graphically depicting the change in viscosity of a preferred gel-forming solution (2 wt % agar solution). The graph clearly illustrates the features of our gel-forming materials: low gel-forming temperature and rapid gelation over a narrow temperature range.

The gel-forming material is provided in an amount between 0.2 wt % and about 5 wt % based upon the solids in the mixture. More than about 5 wt % of the gel-forming material may be employed in the mixture. Higher amounts are not believed to have any adverse impact on the process, although such amounts may begin to reduce some of the advantages produced by our novel compositions, especially with respect to the production of net shape and near shape bodies. Most preferably, the gel-forming material comprises between about 1 percent and about 3 percent by weight of solids in the mixture.

The mixture further comprises a gel-forming material solvent. While any of a variety of solvents may be employed, depending upon the composition of the gel-forming material, particularly useful solvents for agaroid-containing gel-forming materials are polyhedric liquids, particularly polar solvents such as water or alcohols, and liquids such as carbonates and any mixtures thereof. It is, however, most preferable to employ a solvent which can also perform the dual function of being a carrier for the mixture, thus enabling the mixture to be easily supplied to a mold. We have discovered that water is particularly suited for serving the dual purpose noted above. In addition, because of its low boiling point, water is easily removed from the self-supporting body prior to and/or during firing.

A liquid carrier is normally added to the mixture to produce a homogeneous mixture of the viscosity necessary to make the mixture amenable to being molded by the desired molding process. Generally, the amount of a liquid carrier is an amount (between about 3 percent to about 50 percent by weight of the mixture depending upon the desired viscosity thereof. In the case of water, which performs the dual function of being a solvent and a carrier for agaroid-containing mixtures, the amount is simply between about 4 percent and about 20 percent by weight of the mixture, with amounts between about 5 percent and about 10 percent by weight being preferred.

The mixture may also contain a variety of additives which can serve any number of useful purposes. For example, coupling agents and/or dispersants may be employed to ensure a more homogeneous mixture. Certain metal borate compounds, most notably borates of Ca, Mg and Zn, can be added to increase the strength of as-molded parts and resist cracking upon removal of parts from the die. Lubricants such as glycerin and other mono-hedric and poly-hedric alcohols may be added to assist in feeding the mixture along the bore of an extruder barrel and/or reduce the vapor pressure of the liquid carrier and enhance the production of the near net shape objects. Biocides may be added to impede bacteria growth.

The amount of additives will vary depending on the additive and its function within the system. However, the additives must be controlled to ensure that the gel strength of the gel-forming material is not substantially destroyed. For example, Table 1 below shows the effect on the gel strength of the gel-forming material in aqueous solution by LICA-38J (Kenrich Petrochemicals, Inc.), an additive that may be used to enhance the processing of the metal powder in the molding formulation. Table 2 shows gel strength enhancement using calcium borate additive.

TABLE 1

Additive Concentration on Agar Gel Strength

| Additive | Agar W %: | Gel Strength |
|---|---|---|
| None | 3.85 | 1480 ± 77 g/cm$^2$ |
| 0.95 wt % LICA-38J | 3.80 | 1360 ± 7 g/cm$^2$ |

TABLE 2

Calcium Borate Enhancement of Agar Gel Strength

| Additive | Agar W %: | Gel Strength |
|---|---|---|
| None | 1.5 | 689 g/cm$^2$ |
| 0.42 wt % calcium borate | 1.5 | 1297 g/cm$^2$ |

The mixture is maintained at a temperature above the gel point (temperature) of the gel-forming material prior to being supplied to the mold. Ordinarily, the gel point of the gel-forming material is between about 10° C. and about 60° C., and most preferably is between about 30° C. and about 45° C. Thus, while the mixture must be maintained at a temperature above the gel point of the gel-forming material, the gel-forming materials of the present invention substantially reduce the amount of cooling of the mold normally required with the prior art processes. Usually, the temperature of the mixture is maintained at less than 100° C., and preferably is maintained at about 90° C.

The mixture is supplied to the mold by any of a variety of well known techniques including gravity feed systems, and pneumatic or mechanical injection systems. Injection molding is the most preferred technique because of the fluidity and low processing temperatures of the mixtures. The latter feature, low processing temperatures, is especially attractive in reducing the thermal cycling, (thus increasing mold life) to which molds of the injection equipment are subjected.

A vary wide range of molding pressures may be employed. Generally, the molding pressure is between about 20 psi and about 3,500 psi, although higher or lower pressures may be employed depending upon the molding technique used. Most preferably, the molding pressure is in the range of about 100 psi to about 1500 psi. An advantage of the present invention is the ability to mold the novel compositions using low pressures.

The mold temperatures must, of course, be at or below the gel point of the gel-forming material in order to produce a self-supporting body. The appropriate mold temperature can be achieved before, during or after the mixture is a supplied to the mold. Ordinarily, the mold temperature is maintained at less than about 40° C., and preferably is between about 10° C. and about 25° C. Thus, for example, it is expected that optimum production rates would be achieved with an injection molding process wherein the preferred gel-forming materials (which exhibit gel points between about 30° C. and about 45° C.) are employed to form a mixture maintained at about 90° C. or less, and wherein the mixture is injected into a mold maintained at about 25° C. or less.

After the part is molded and cooled to a temperature below the gel point of the gel forming material, the green body is removed from the mold and dried. The green body, being a self supporting body, requires no special handling before being placed into the furnace. The green body is then placed directly into the furnace after being removed from the mold or is further dried prior to being placed in the furnace. In the furnace, the body is fired to produce the final product. Before being brought to sintering temperature in reducing atmosphere the body may be heated in air at slightly elevated temperatures to about 250° C. to assist in removal of the small amount of organic matter in the body. The firing times and temperatures (firing schedules) are regulated according to the powdered material employed to form the part. Firing schedules are well know in the art for a multitude of materials and need not be described herein.

Because of the use of the novel molding compositions of the present invention, no supporting materials are required during firing. Ordinarily for wax-based systems, an absorbent, supporting powder is employed to assist in removing the wax from the part and to aid in supporting the part so that the intended shape of the product is maintained firing. The present invention eliminates the need for such materials.

Figure 3:
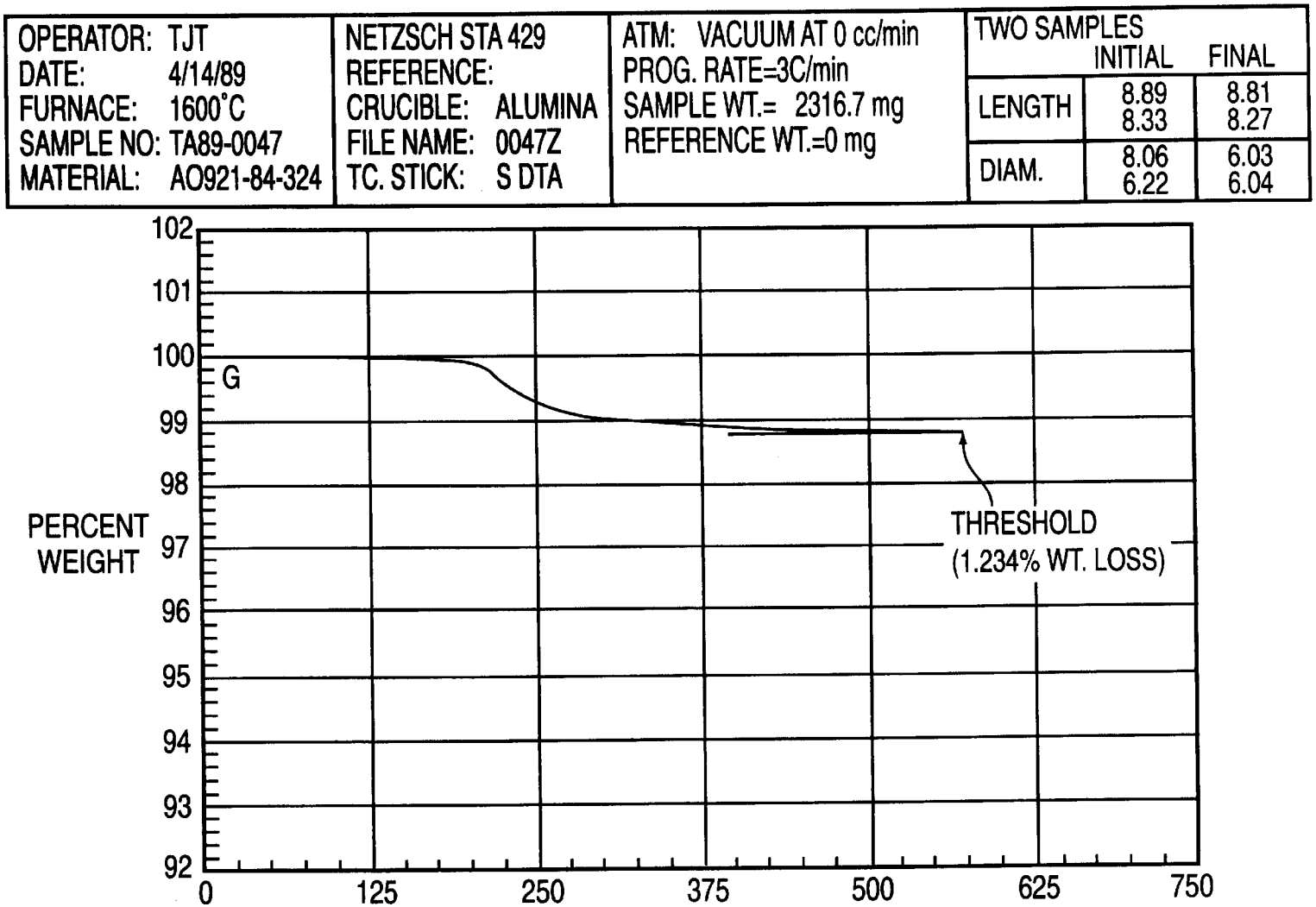
FIG. 3 is a graphic representation of the weight loss exhibited by a product produced by a process of the invention.

The fired products produced by the present invention can be very dense, net or near net shape products. FIG. 3 illustrates the weight loss exhibited by an injection molded metal product of the present invention heated in vacuum to 570° C. to remove the binder. As shown, the weight loss was a mere 1.23% the total weight loss upon further heating in 5% H2/Ar to the sintering temperature of 1376° C. was 1.38%.

Having described the invention in full, clear and concise terminology, the following example is provided to illustrate some embodiments of the invention. The example, however, is not intended to limit the scope of the invention. It will be understood that such detail need not be strictly adhered to, but that various changes and modifications may suggest themselves to one skilled in the art, all falling within the scope of the present invention as set forth in the claims.

EXAMPLES

In the following examples weight percent solids includes all residual material after removal of volatiles at 120° C. The theoretical density values used for 316 and 17-4PH stainless steels are 8.02 g/cm$^3$ and 7.78 g/cm$^3$, respectively. Shrinkage on fired 99% TD fired parts around 16.5%.

Example 1

Batch 316A-063

A formulation composed of 8236 g 316L metal powder (Anval 316L −22 μm powder), 612 g D.I. water, 165 g agar, 11.6 g calcium borate, 1.6 g methyl-p-hydroxy benzoate and 1.2 g propyl-p-hydroxy benzoate was prepared in a sigma blender at 90.5° C. for 1 h. Upon cooling, the mixture was removed from the blender and shredded in a Hobart food shredder. The solids content was 93 wt %. The material was supplied to the hopper of an injection molding machine (Cincinnati 33 ton). Tensile bars (dims of fired parts: pin length 4.22", width 0.42", thickness 0.10") were molded at 1000 psi injection pressure (hydraulic). The bars were dried, heated in air at 225° C. for 2 h and 450° C. for 2 h, and then sintered in hydrogen 2 h at 1375° C. Properties are listed in Table 3.

Example 2

Batch 316A-070

The method of Example 1 was followed except that the powder mixture was pre-blended to contain 70% −22 μm powder and 30 wt % −16 μm powder. Properties of sintered tensile bars are given in Table 3.

Example 3

Batch 316A-069

The method of Example 1 was followed except that −16 μm powder was used. Properties of sintered tensile bars are given in Table 3.

Example 4

Batch 174U-044

The method of Example 1 was followed except that 7982 g 17-4PH metal powder was used (Ultrafine Powders −20 μm 17-4PH powder. The sintering schedule consisted of 2 h at 260° C. in air followed by 1343° C. for 2 h in hydrogen. Tensile bars were molded at 93% solids; properties are given in Table 3.

Examples 5 and 6 refer to parts other than tensile bars.

Example 5

Batch 174U-044

The method of Example 4 was followed. A part called "5-step" was molded at 92.3 wt % solids and 600 psi injection pressure (hydraulic). The part consists of 5 adjacent steps of varying thickness; overall height 2.07" and width 1.25". The successive step thicknesses from top to base are: step 1: 0.036", step 2 0.049", step 3 0.170", step 4 0.339", step 5 0.846". A density of 99.1% TD was achieved. Average shrinkage was 17%.

Example 6

Batch 174U-087

The method of Example 4 was followed except that the mixture contained no borate. A part called "turbocharger vane" was molded at 92.7 wt % solids and injection pressures ranging from 500–1000 psi (hydraulic) on a Boy 15S injection molding machine. The sintering schedule consisted of 2 h at 300° C. in air followed by 2 h at 1360° C. in hydrogen. The density of the parts was 97% TD.

Example 7

Batch 316A-064

The method of Example 1 was followed. The solids content of the material was 92.9 wt %. The material was supplied to the hopper of an injection molding machine (Boy 22 ton). A part termed "3-hole insulator" was molded at 250–600 psi (hydraulic), dried and sintered at 1343° C. in nitrogen. The part is cylindrical, 0.83" in height. The outer diameter consists of two equal sections, the upper half 0.41" dia and the lower half 0.46" dia (dimensions nominal). The average density of the parts was 97.7% TD.

TABLE 3

Sintered Tensile Bar Properties

| Example | Stainless steel | Yield Strength psi | Ultimate Tensile strength psi | Elongation % | Density % TD | Hardness Rockwell |
|---|---|---|---|---|---|---|
| 1 | 316 | 33,500 | 76,500 | 90 | 99.76 | 61.5 RB |
| 2 | 316 | 32,000 | 73,000 | 77 | 99.3 | 58.4 RB |
| 3 | 316 | 32,000 | 73,000 | 77 | 98.9 | 59 RB |
| 4 | 17-4PH | 133,000 | 149,000 | 6 | 99.1 | 25 RC |

We claim:

1. A method for forming a stainless steel article comprising the steps of:

a) forming a mixture comprising 1) powder containing at least one member selected from the group consisting of pure stainless steel alloys, stainless steel alloying elements, intermetallic compounds, components of metal matrix composites and mixtures thereof;

2) a gel-forming material;

3) a gel-forming material solvent; and 4) a gel strength enhancing agent having the form of a borate compound selected from the group consisting of calcium borate, magnesium borate and zinc borate, wherein the mixture is heated to and maintained above the gel point of said gel-forming material; and b) molding the mixture at a temperature sufficient to produce a self-supporting stainless steel article comprising the powders and a gel comprising the gel-forming material.

2. The method of claim 1 wherein the gel forming material comprises an agaroid.

3. The method of claim 2 wherein the agaroid is agar, agarose, or a mixture thereof.

4. The method of claim 1 wherein the powders comprise between about 50% to about 96% of the mixture.

5. The method of claim 1 wherein the gel-forming material has a gel strength, measured at a temperature between 0° C. and 30 C. on a gel consisting essentially of about 1.5 wt % of the gel-forming material and water, of at least about 200 g/cm2.

6. The method of claim 1 wherein the gel forming material comprises between about 0.5% and about 5% by weight based on the solids in the mixture.

7. The method of claim 6 wherein the gel-forming material is an agaroid.

8. The method of claim 7 wherein the mixture further comprises additives comprising coupling agents, dispersants and monomeric mono- and/or polyhedric alcohols.

9. The method of claim 8 wherein the borate compound is present in an amount up to about 10% by weight of the gel forming solvent in the mixture.

10. The method of claim 7 wherein the agaroid is agar, agarose, or a mixture thereof.

11. The method of claim 1 further comprising the step of maintaining the mixture at a temperature above the gel point of the gel-forming material prior to the molding step (b).

12. The method of claim 11 wherein the temperature of the mixture during the molding step is reduced to a temperature below the gel point of the gel-forming material.

13. The method of claim 1 further comprising the step of firing the self-supporting article to form a final product.

14. The method of claim 1 wherein said borate compound is present in an amount of up to about 10% by weight of the gel forming solvent in the mixture.

15. The method of claim 14 wherein said powder is a pure stainless steel alloy.

16. The method of claim 1 wherein said solvent is water.

17. An injection molding process comprising the steps of:

a) forming a mixture comprising 1) powders selected from the groups of stainless steel powders;

2) a gel-forming material having a gel strength, measured at a temperature between 0° C. and about 30° C. on a gel comprising about 15 wt % of the gel forming material and water, of at least about 200 g/cm$^2$;

3) a gel-forming material solvent; and, 4) a gel strength enhancing agent having the form of a borate compound selected from the group consisting of calcium borate, magnesium borate and zinc borate, wherein the mixture is heated to and maintained above the gel point of said gel-forming material; and b) injecting the mixture into a mold, the mixture being maintained prior to the injection step at a first temperature above the gel point of the gel forming agent; and c) cooling the mixture in the mold to a second temperature below the gel point of the gel-forming agent to form a self supporting article comprising the powders and a gel comprising the gel forming material.

18. The process of claim 17 wherein the powders are present in the mixture in an amount between about 50% and about 95% by weight of the mixture, the gel-forming material is present in the mixture in an amount between about 0.5 and about 5% by weight of the mixture, and water is present as the solvent in an amount sufficient to function as a carrier.

19. The process of claim 17 wherein the gel-forming material comprises an agaroid.

20. The method of claim 19 wherein the agaroid is agar, agarose, or a mixture thereof.

21. The process of claim 17 wherein the gel-forming material is an agaroid.

22. The method of claim 21 wherein the agaroid is agar, agarose, or a mixture thereof.

23. The process of claim 17 wherein the mixture further comprises coupling agent, dispersant and monomeric mono- and/or polyhedric alcohols.

24. The process of claim 23 wherein the borate is present in an amount up to about 10% by weight of the solvent in the mixture.

25. The process of claim 17 further comprising the step of firing the self supporting article to form a final product.

26. The process of claim 17 wherein said borate compound is present in an amount up to about 10% by weight of the solvent in the mixture.

27. The process of claim 17 wherein said solvent is water.

* * * * *